US006012519A

United States Patent [19]

Allen et al.

[11] Patent Number: 6,012,519

[45] Date of Patent: Jan. 11, 2000

[54] FULL BORE TUBING HANGER SYSTEM

[75] Inventors: Jack R. Allen, Milan; Heinrich H. Lang, The Woodlands, both of Tex.

[73] Assignee: ERC Industries, Inc., Houston, Tex.

[21] Appl. No.: 09/020,480

[22] Filed: Feb. 9, 1998

[51] Int. Cl.[7] ..... E21B 33/04

[52] U.S. Cl. ..... 166/75.14; 166/208; 166/217

[58] Field of Search ..... 166/75.14, 86.1, 166/208, 207

[56] References Cited

U.S. PATENT DOCUMENTS

| | | | |
|---|---|---|---|
| 1,326,272 | 12/1919 | Kinzbach . | |
| 2,157,964 | 5/1939 | Mueller | 166/15 |
| 3,255,823 | 6/1966 | Barton | 166/85 |
| 3,420,308 | 1/1969 | Putch | 166/208 |
| 3,741,589 | 6/1973 | Herd et al. | 285/3 |
| 4,190,270 | 2/1980 | Vanderford | 285/142 |
| 4,373,752 | 2/1983 | Nelson | 166/208 |
| 4,541,490 | 9/1985 | Bigbie et al. | 166/379 |
| 4,646,827 | 3/1987 | Cobb | 166/88 |
| 4,923,006 | 5/1990 | Hartmann et al. | 166/65.1 |
| 4,936,382 | 6/1990 | Thomas | 166/88 |
| 5,026,097 | 6/1991 | Reimert | 166/208 |
| 5,092,400 | 3/1992 | Jagert | 166/88 |
| 5,467,825 | 11/1995 | Vallet | 166/379 |
| 5,507,349 | 4/1996 | Wray et al. | 166/382 |
| 5,515,926 | 5/1996 | Boychuk | 166/379 |
| 5,522,464 | 6/1996 | Piper | 166/77.2 |
| 5,544,706 | 8/1996 | Reed | 166/379 |

*Primary Examiner*—Hoang Dang
*Attorney, Agent, or Firm*—Head, Johnson & Kachigian

[57] ABSTRACT

A full bore tubing hanger system for supporting a tubing string in a wellhead includes a hanger body positioned on the wellhead and having a vertical opening therethrough defined by a plurality of spaced apart circumferential enlarged internal diameter support recesses, each support recess providing a lower circumferential radial ledge surface and an upper frusto-conically shaped surface. A tubular tubing hanger is removably positionable within the hanger body vertical opening and has threads at the lower end thereof by which tubing is attached to it. A segmented cage is positioned on the external surface of the tubing hanger and slidable between a lower and an upper position, in the lower position the segmented cage is retracted with respect to the external surface of the tubing hanger. The segmented cage has spaced apart external circumferential support surfaces that, when the tubing hanger is downwardly positioned, engage the hanger body support recesses so that the tubing hanger is supported by the cage. The segmented cage is inwardly radially retractable when upward force is applied to the tubing hanger so that the tubing hanger and cage may be removed from within the hanger body.

5 Claims, 4 Drawing Sheets

*Fig. 4*
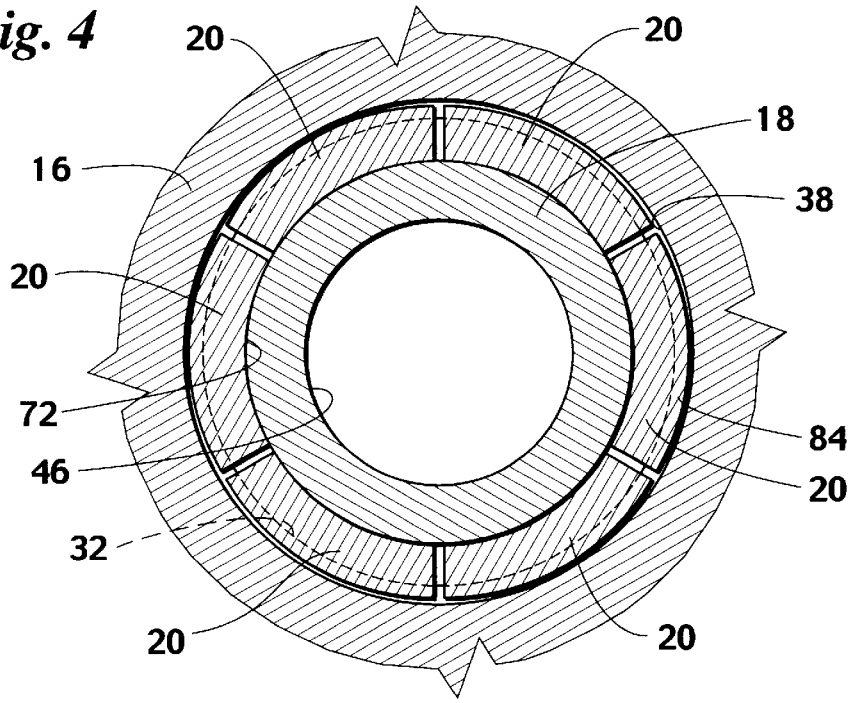
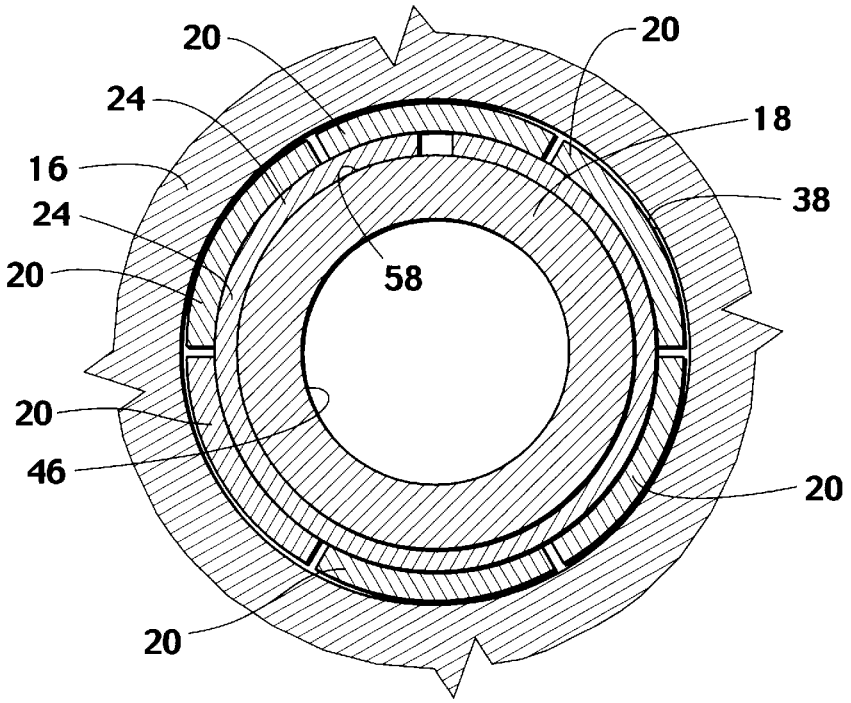
*Fig. 5*

FULL BORE TUBING HANGER SYSTEM

REFERENCE TO PENDING APPLICATIONS

This application is not related to any pending applications.

REFERENCE TO MICROFICHE APPENDIX

This application is not referenced in any microfiche appendix.

BACKGROUND OF THE INVENTION

When an oil well is completed after a borehole has been drilled from the earth's surface into a producing formation it is normally necessary to suspend a string of tubing in the borehole so that production fluid is conveyed from the formation to the earth's surface where it can be processed into a lubricating oil, gasoline, diesel fuel and other products that are indispensable for life on the earth as we know it.

Most oil wells include a surface casing on which a wellhead is mounted and a system must be provided in conjunction with the wellhead for suspending tubing in the borehole. Tubing is always suspended, that is, it is never placed in the borehole and the weight of the tubing string allowed to rest on the lower end of the tubing string. For this reason, the mechanism which must support the weight of a long tubing string, frequently exceeding a mile in length, must be carefully designed and constructed.

In the past a typical means of suspending tubing in a wellhead has been by the use of tapered jaws that fit inside an internally tapered body. The jaws have gripping surfaces that when forced by the tapered surface of the tubing hanger into the exterior of the tubing grip the tubing with sufficient strength to suspend it in a bore hole. While this well known system works satisfactorily, it has disadvantages. In recent years, a technique in which a threaded fitting is secured to the upper end of the tubing and the fitting itself is releasably locked into a wellhead has come into use. It is to this latter type of tubing suspension system that this invention is directed.

For background information relating to weliheads and systems for suspending tubing, reference can be had to the following previously issued United States patents:

| U.S. PAT. NO. | INVENTOR | TITLE |
|---|---|---|
| 1,326,272 | Kinzbach | Casing Head |
| 2,157,964 | Mueller | Tubing Hanger |
| 3,255,823 | Barton | Orienting and Locking Conductor |
| 4,541 ,490 | Bigbie et al | Adapter For A Wellhead |
| 4,646,827 | Cobb | Tubing Anchor Assembly |
| 4,936,382 | Thomas | Drive Pipe Adaptor |
| 5,092,400 | Jagert | Coiled Tubing Hanger |
| 5,507,349 | Wray et al | Downhole Coiled Tubing Latch |
| 5,522,464 | Piper | Hydraulic Tubing Head Assembly |
| 5,544,706 | Reed | Retrievable Sealing Plug Coil Tubing Suspension Device |

BRIEF SUMMARY OF THE INVENTION

A full bore tubing hanger system for supporting a tubing string in a wellhead in which the wellhead has a vertical opening therethrough includes a hanger body demountably supported on the wellhead. The hanger body has a lower support surface resting on an upper support surface of the wellhead. The hanger body has a vertical opening therethrough in alignment with the wellhead vertical opening. The hanger body vertical opening is defined by a first enlarged internal diameter circumferential control recess having upper and lower frusto-conically shaped shoulder. The vertical opening is further defined by a plurality of spaced apart circumferentially enlarged internal diameter support recesses. Each of the support recesses has a lower circumferential radial ledge surface and an upper frusto-conical surface.

A tubular hanger is removably positioned within the hanger body vertical opening. The tubular hanger has internal threads at the lower end by which it is threadably secured to the upper end of a string of tubing. Tubing hanger has an integral enlarged external diameter flange portion having an external diameter slightly less than the hanger body internal opening. The tubular hanger is vertically telescopically positionable within or removable from within the hanger body vertical opening.

A segmented cage is slidably positioned on the external surface of the tubular hanger and slidable between a lower and an upper position. In the lower position the segmented cage is retracted within recesses in the external surface of the tubing hanger. The segmented cage has at an upper portion spaced apart circumferential ledges. When the tubing hanger is downwardly positioned with respect to the cage the segmented ease is expanded radicaly outward and these circumferential ledges engage the hanger body support recess so that the tubing hanger is supported by the cage.

The segmented cage is inwardly radially retractable when upper force is applied to the tubing hanger so that the cage may be upwardly vertically removed from within the hanger body.

A better understanding of the invention will be obtained from the following description of the preferred embodiment, taken in conjunction with the attached drawings and the claims.

DESCRIPTION OF THE DRAWINGS

FIG. 2 shows the tubing hanger as having been positioned within the hanger body but in which the tubing hanger is not supporting a string of tubing. The relationship of components in FIG. 2 can represent the status of the components when a tubing hanger is first inserted into the hanger body before the weight of a tubing string is applied or in the intermediate stage of removing the tubing hanger from the hanger body.

In FIG. 3 the segmented cage is in the full upward position providing support against a circumferential shoulder of the tubing hanger and wherein the segmented case is fully outwardly expanded to engage internal circumferential grooves in the hanger body so that the weight of a tubing string is transferred first to the tubing hanger, thence to the segmented cage and finally to the hanger body which, in turn, is, as shown in FIG. 1, supported by a wellhead.

FIG. 4 is a cross-sectional view as taken along the line 4—4 of FIG. 1 showing the tubing hanger, a segmented ring, the segmented cage and the hanger body in cross-section.

FIG. 5 is a cross-sectional view taken along the line 5—5 of FIG. 1 showing the segmented cage as radially outwardly expanded into full engagement with the circumferential internal grooves in the hanger body by which the weight of a string of tubing is supported.

DETAILED DESCRIPTION OF THE PREFERRED EMBODIMENT

Figure 1:
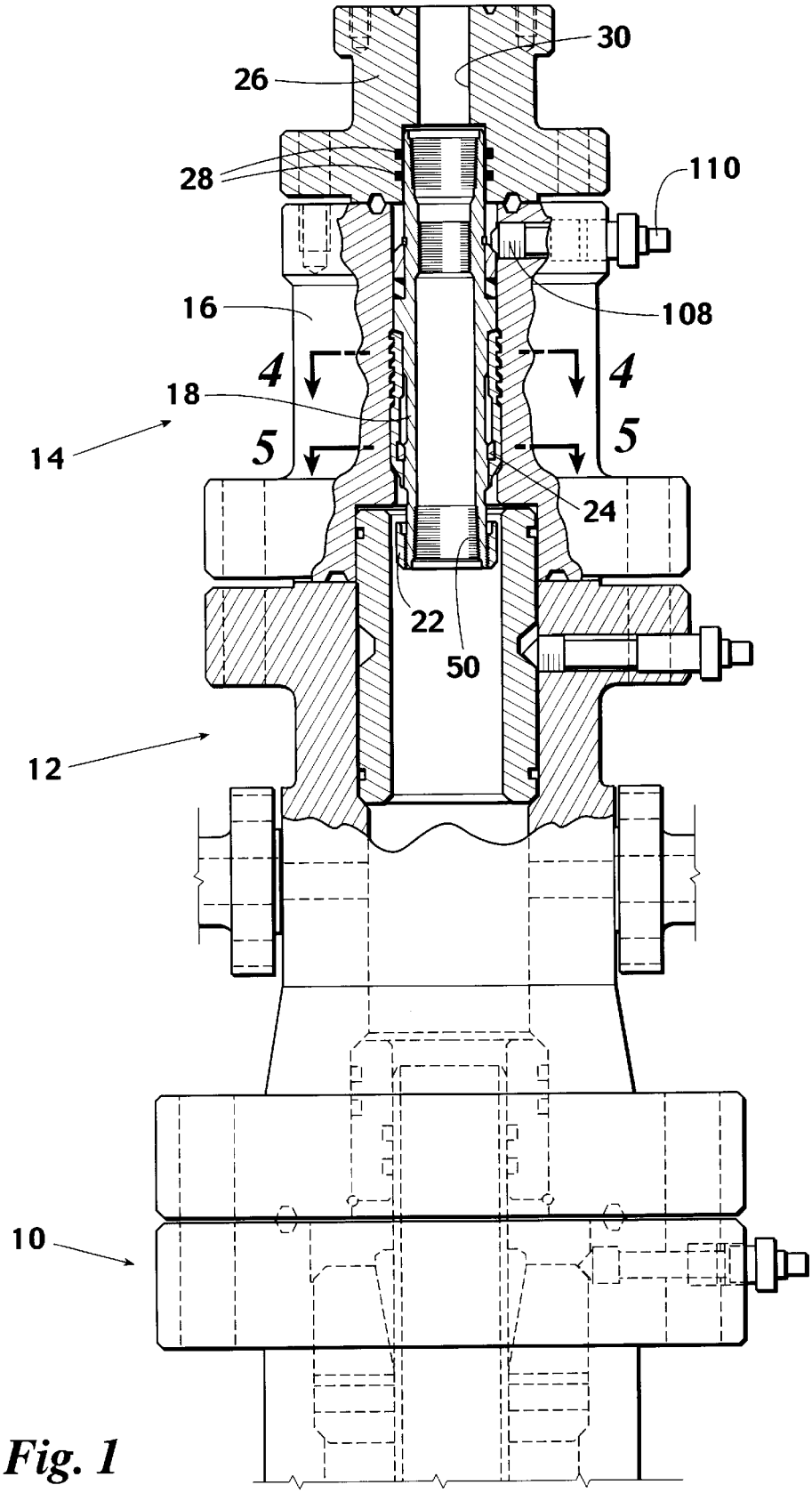
FIG. 1 is an elevational partially cross-sectional view of a wellhead shows the environment in which the full bore tubing hanger system of this invention is employed. The tubing hanger system is supported on the wellhead and is shown partially in cross-section.

FIG. 1 illustrates the environment in which a full bore tubing hanger system of this invention is employed in the completion of an oil or gas well. A casing head is generally indicated by the numeral 10 and is of the type that is commonly secured to the upper end of surface casing that is cemented in position in the earth as a part of the process of drilling an oil or gas well. Positioned on top of casing head 10 is a well head generally indicated by the numeral 12 and positioned on top of the wellhead is the full bore tubing hanger system of this invention, generally indicated by numeral 14.

The basic elements of full bore tubing hanger system 14 are: a hanger body 16; a tubing hanger 18 and a segmented cage 20. In addition to these basic components, other elements of the system are a retainer collar 22 and a split ring 24 all of which will be described in detail subsequently.

Positioned on top of the upper end of hanger body 16 is an adapter flange 26 that receives, in a recess therein, the upper end of tubing hanger 18. Seals 28 positioned in the interior of the adapter flange seal against the exterior of the tubing hanger. Piping (not shown) or other equipment may be attached to the upper end of adapter flange 26 for conducting fluids and/or gases away from the well.

Figure 2:
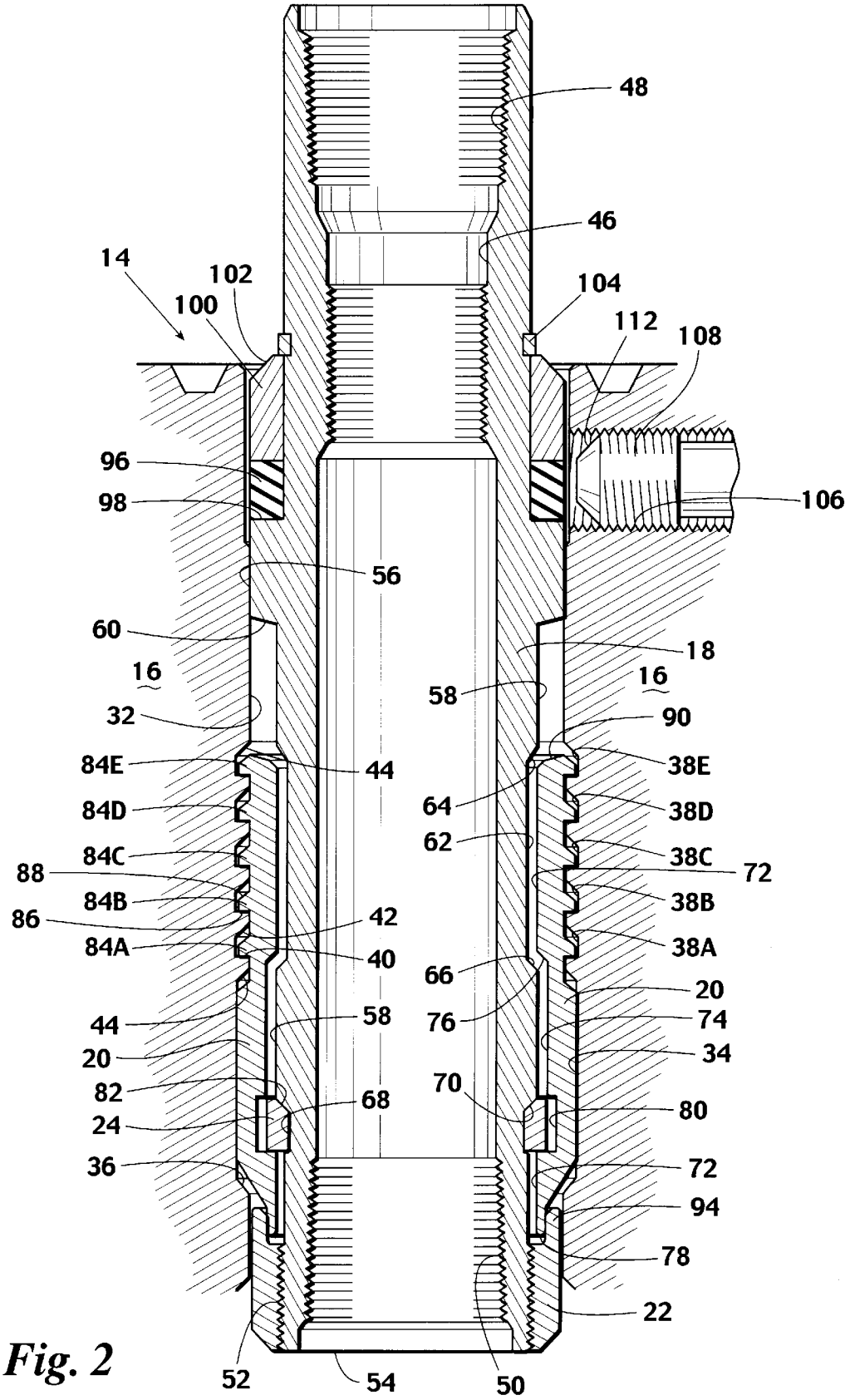
FIG. 2 is an enlarged view of (1) a portion of a hanger body, (2) a tubing hanger and (3) a segmented cage which make up the basic components of the tubing hanger system.
Figure 3:
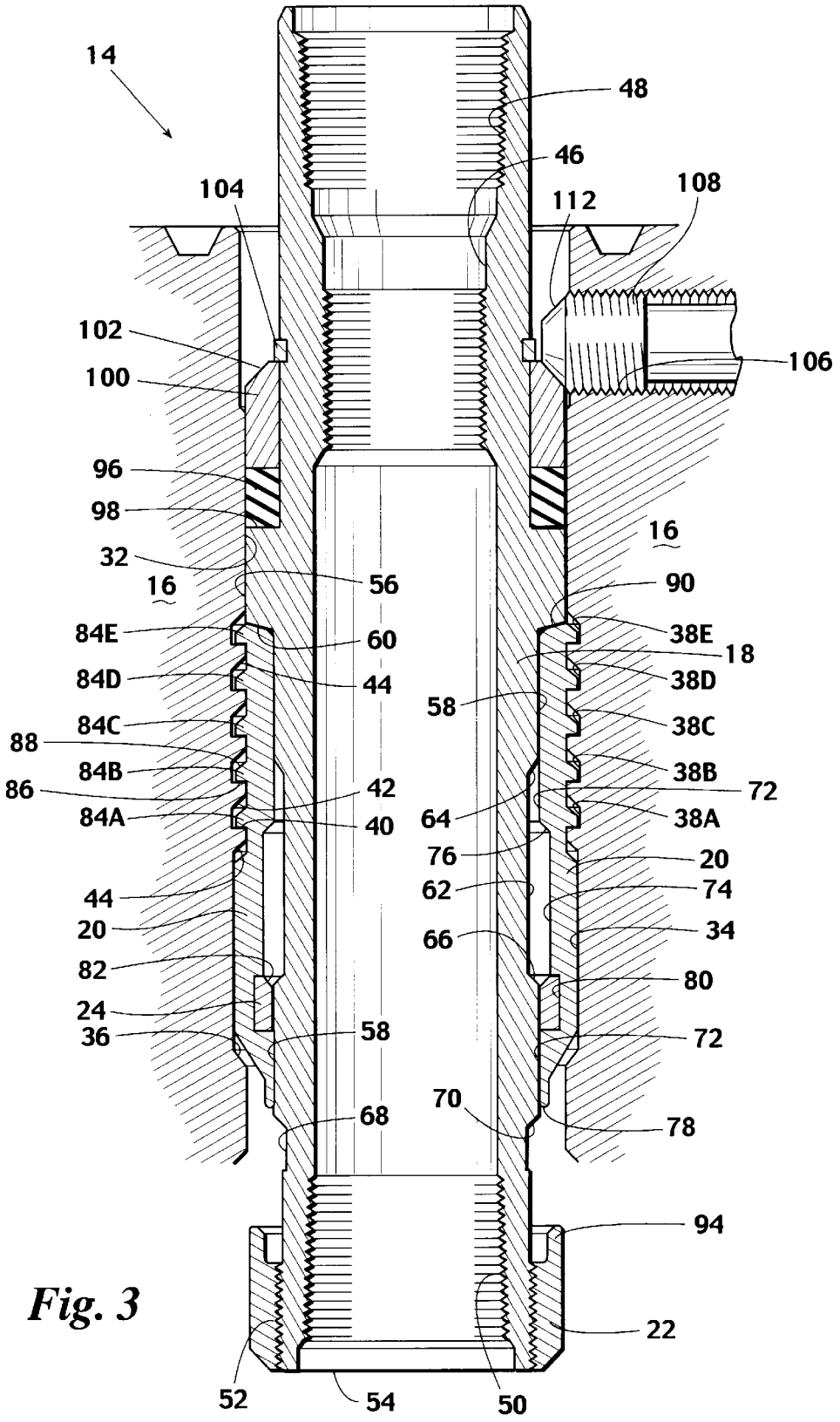
FIG. 3 is a cross-sectional view as in FIG. 2 but showing the tubing hanger in position when the weight of a tubing string (not shown) is suspended from it.

FIGS. 2 and 3 are enlarged cross-sectional views of the basic components of the tubing hanger system 14 in which only a fragmentary internal portion of hanger body 16 appears. Hanger body 16 has a vertical central passageway 32 therethrough that has an enlarged internal diameter portion 34 adjacent the lower end thereof, the enlarged internal diameter portion providing a lower circumferential shoulder 36.

In addition, the hanger body central passageway is further defined by a plurality (five being shown) of circumferentially enlarged internal diameter support recesses indicated by the numerals 38A through 38E. Each of support recesses 38A through 38E has, at its lower end thereof, a radial circumferential ledge 40 (only the ledge for support recess 38A being identified) and each of the support recesses 38A through 38E has, at its upper end, a circumferential upwardly inclined frusto-conical tapered recess 42, only the tapered recess of support recess 38A being identified.

Enlarged internal diameter control recess 34 has, at the upper end thereof, a circumferential frusto-conical surface 44 that forms an upper circumferential shoulder whose function will be described subsequently.

Telescopically and removably positioned within central passageway 32 of hanger body 16 is tubing hanger 18 having a central passageway 46 therethrough. The upper end of passageway 46 is internally threaded at 48 and, in like manner, internal threads 50 are provided at the lower end. External threads 52 are also provided at the lower end 54 of tubing hanger 52, the external threads 52 receiving retainer collar 22 whose function will be subsequently described.

Tubing hanger 18 has a maximum external diameter surface 56 that is slightly less than the internal diameter 36 of hanger body central passageway 32 so that tubing hanger 18 can be telescopically positioned within the hanger body. A first reduced external diameter portion 58 formed as a part of the external surface of tubing hanger 18 provides an upper frusto-conical circumferential shoulder 60 that is important in the support of a string of tubing as will be described.

A second reduced external diameter portion 62 formed in the tubing hanger external surface provides an upper circumferential frusto-conical shoulder 64 and a lower circumferential shoulder 66 that have functions to be described.

A third reduced external diameter recess 68 that is adjacent to the tubing hanger lower end 54 has an upper circumferential frusto-conical shoulder 70.

Slidably positioned on the exterior of tubing hanger 18 is the segmented cage 20 that is tubular in construction and is formed of segments as shown in FIGS. 4 and 5. FIG. 2 shows segmented cage 20 in a downward position relative to hanger body 16 and also relative to tubular hanger 18 while FIG. 3 shows the segmented cage in its same elevational position with respect to hanger body 16 but wherein tubular hanger 18 is vertically downwardly displaced relative to both the hanger body 16 and segmented cage 20. FIG. 2 shows the basic elements of the invention, that is, the hanger body 16, tubing hanger 18, and segmented cage 20 in a position that would occur either during the first insertion of tubing hanger 18 into hanger body 16 or when upward pull is first applied to tubing hanger 18 to extract it from the hanger body. In contrast, FIG. 3 shows the relationship of the components in which tubing hanger 18 is securely anchored within hanger body 16 as supported by segmented cage 20, which is the positions these basic components occupy when the tubing hanger is supporting a string of tubing attached to its lower end.

The segmented cage has, when the elements of the cage are positioned contiguous to each other, an internal passageway 72 that is substantially equal to the external diameter of the second reduced external surface 62 of tubing hanger 18. The internal surface of the tubular segmented cage 20 has an increased internal diameter area 74 that terminates at its upper end with a circumferential frusto-conical surface 76.

The tubular segmented cage further has, adjacent its lower end 78, a circumferential increased internal diameter recess 80 that receives split ring 24 as illustrated in the cross-sectional view of FIG. 5. Split ring 24 has an outwardly inclined frusto-conical surface 82 that slidably engages the upper shoulder 70 of tubing hanger 18 as previously described.

Integrally formed on the exterior of the segmented cage are a plurality of spaced apart (five being shown) circumferential ledges 84A through 84E. Each of the circumferential ledges has a radial bottom surface 86 and a frusto-conically shaped upper surface 88.

The upper end of cage 20 has a beveled or inclined circumferential surface 90 that is configured to match shoulder 60 on the exterior of tubular hanger 18.

The external diameter of segmented cage 20 is substantially reduced at lower end 78 providing an integral circumferential lip portion 92 that is slidably and telescopically received within a surrounding circumferential lip portion 94 formed at the upper end of retainer collar 22.

Telescopically received on the exterior of tubing hanger 18 is a circumferential elastomeric member 96 that rests on a circumferential radial ledge 98 formed on the tubing hanger. A retainer ring 100 is slidably positioned on the exterior of the tubing hanger, the retainer ring having a circumferential inclined shoulder 102. Retainer ring 100 and elastomeric member 96 are retained in position by means of a keeper ring 104 retained in a circumferential groove on the exterior surface of the tubular hanger.

Formed in the upper portion of hanger body 16 is a threaded radially extending opening 106 that communicates between the exterior of the hanger body and central passageway 32. Threadably positioned in opening 106 is a retainer bolt 108 that, as seen in FIG. 1, has a wrench engaging surface 110 exterior of the tubular hanging system by which bolt 108 may be threadably inwardly or outwardly advanced.

The description to this point has been concerned with the structural features of the full bore tubing hanger system. The method of employment of the system will now be described.

METHOD OF USE

FIG. 1 shows tubular hanger system 14 supported on a wellhead 12 which, in turn, is supported on a casing head 10 and shows tubular hanger 18 within hanger body 16 in the position at which it would be employed to support a string of tubing suspended from the tubing hanger lower end. The string of tubing is not shown but an upper threaded end of such string of tubing is normally by threadably received within the tubing hanger lower threads 50. The relationship of components of the tubing hanger system as illustrated in FIG. 1 are shown in enlarged and better view in FIG. 3, that is, FIG. 3 shows the tubing hanger system as deployed to support a string of tubing within a borehole.

Referring to FIG. 2, with retaining bolt 108 outwardly withdrawn as shown, string of tubing can be inserted into the borehole downwardly through central passageway 32 in hanger body 16. At the upper end of the string of the tubing is threadably assembled tubing hanger 18. Positioned on the tubing hanger is segmented cage 20 which is in the position as shown in FIG. 2, that is, wherein the segmented cage lower end 78 is received within the lip portion 94 of retainer collar 22. The segmented cage is retained in its contracted position in close contiguous relationship with the exterior of tubing hanger 18 as the cage passes downwardly through the upper portion of central passageway 32. When the downward travel of the tubular hanger reaches the position shown in FIG. 2, the segmented cage is free to radially outwardly expand, as illustrated in FIG. 2 so that the cage circumferential ledges 84A through 84E expand outwardly to enter hanger body circumferential recesses 38A through 38E thereby locking the cage elevationally to to hanger body 16. Further downward translation of tubing hanger 18 relative to cage 20 locks the segments of the segmented cage in their furthermost outward position as shown in FIGS. 1 and 3. Particularly, further downward translation of tubing hanger 18 relative to cage 20 outwardly displaces split ring 24 by contact of the ring upper shoulder 82 with the frusto-conical surface 70 formed on the exterior of tubing hanger 18. Further, the first reduced external diameter surface 58 of tubing hanger 18 engages inner passageway 72 of the segmented cage to lock it in outward position and specifically to lock the circumferential ledges 84A through 84E into support recesses 38A through 38E. The cage upper circumferential shoulder 90 engages tubing hanger shoulder 60 to thereby support the tubing hanger against further downward translation relative to hanger body 16. Thus, the tubing hanger, with tubing suspended below it, is securely elevationally positioned within hanger body 16.

Thereafter, retaining bolt 108 (or retaining bolts if a plurality are employed) is radially inwardly advanced so that a tapered surface 112 engages inclined shoulder 102 of retainer ring 112 to lock the tubing hanger against inadvertent upward displacement. This locking steps tends to force retainer ring 102 downwardly, compressing elastomeric seal 96 to seal against passage of liquids or gases from within the well externally of the tubing hanger.

To remove the tubing from the wellhead all that is required is that retaining bolt 108 be retracted to the position as shown in FIG. 2, and upward pull be applied to tubing hanger 18. This is typically accomplished by threadably inserting a tool into the upper threaded openings 48. When upward force is applied the tubing hanger 18 moves upwardly relative to segmented cage 20 to the position as shown in FIG. 2. Then, further upward movement of the tubing hanger causes segmented cage 20 to be inwardly collapsed against the external surface of the tubing hanger so as to permit the segmented cage to assume an external diameter permitting it to pass freely upwardly through hanger body central passageway 32. The segmented cage collapses due to the frusto-conical surfaces 88 of each of the circumferential ledges 84 engaging mating frusto-conical surfaces 44 of each of support recesses 38 formed in hanger body 16. Further, split ring 24 insures the proper elevational relationship between the segmented cage and the exterior of the tubing hanger depending upon the elevational position of the tubing hanger with respect to a hanger body 16.

Thus, the tubing hanger system as described herein provides a way of supporting a string of tubing within a wellhead system wherein the passageway through the wellhead system remains fully unobstructed, that is, where the passageway remains full bore and wherein the hanger system employs elements that radially outwardly expand to securely support a tubing string without requiring inward internal restrictive protrusions extending within the hanger body.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. A full bore tubing hanger system for supporting a tubing string in a wellhead, the wellhead having an upper support surface and a vertical opening therethrough, comprising:

a hanger body demountably supported on a wellhead and having a lower support surface resting on an upper support surface of the wellhead and having a vertical opening therethrough in alignment with a wellhead vertical opening, the hanger body vertical opening being defined by a first enlarged internal diameter circumferential control recess having upper and lower frusto-conically shaped shoulders, the vertical opening being further defined by a plurality of spaced apart internally projecting circumferential ledges;

a tubing hanger having a vertical opening therethrough, the tubing hanger being removably positioned within said hanger body vertical opening and having internal threads at the lower end thereof by which tubing may be threadably attached and supported within a wellhead, the tubing hanger having an integral enlarged external diameter flange portion having an external diameter slightly less than said hanger body internal opening, the tubing hanger being vertically telescopically receivable within said hanger body opening;

a segmented cage having an upper end surface and telescopically receiving said tubing hanger, the segmented case having a plurality of spaced apart externally projecting circumferential ledges, when said tubing hanger is downwardly positioned said segmented cage is radially outwardly expanded causing said segmented cage external circumferential ledges to engage said hanger body internal circumferential ledges and said tubing hanger flange portion to engage said segmented cage upper end surface whereby said tubing hanger is vertically supported against further downward displacement relative to said hanger body by said segmented cage, said segmented cage being radially inwardly retracted when upon upward displacement of said tubing hanger whereby said tubing hanger and segmented cage are removable from said hanger body vertical opening.

2. A full bore tubing hanger system according to claim 1 including:

a retainer collar secured externally of said tubing hanger adjacent the lower end thereof and serving to retain said segmented cage on said tubing hanger.

3. A full bore tubing hanger system according to claim 1 including:

a segmented ring received within an internal groove formed within said segmented cage vertical opening and being slidable on the exterior surface of said tubing hanger.

4. A full bore tubing hanger system according to claim 1 including at least one bolt to releasably lock said tubing hanger in a downward position with respect to said hanger body.

5. A full bore tubing hanger system according to claim 1 wherein said tubing hanger has an upper end portion that extends above said hanger body and including:

an adapter flange removably attachable to said hanger body upper end and having a vertical opening therethrough; and seals within said adapter flange sealing said tubing hanger vertical opening to said adapter flange vertical opening.

* * * * *